US006782819B2

(12) United States Patent
Oumiya et al.

(10) Patent No.: US 6,782,819 B2
(45) Date of Patent: Aug. 31, 2004

(54) INKING APPARATUS AND SIDE PLATE THEREOF

(75) Inventors: Nobuyoshi Oumiya, Hasuda (JP); Hideyuki Maezawa, Saitama (JP); Yasunobu Maeda, Iwatsuki (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 10/155,665

(22) Filed: May 23, 2002

(65) Prior Publication Data

US 2002/0174787 A1 Nov. 28, 2002

(30) Foreign Application Priority Data

May 28, 2001 (JP) ..... 2001-159043

(51) Int. Cl.[7] ..... B41F 31/02; B41F 31/06
(52) U.S. Cl. ..... 101/363; 101/208
(58) Field of Search ..... 101/207, 208, 101/210, 350.1, 363, 364, 365, 366, 350.6

(56) References Cited

U.S. PATENT DOCUMENTS 907,638 A * 12/1908 Page ..... 101/210
3,635,161 A * 1/1972 Leanna ..... 101/364
3,831,517 A * 8/1974 Wagner ..... 101/208
4,413,561 A * 11/1983 Toyoda ..... 101/365
4,991,504 A 2/1991 Fina
5,823,110 A * 10/1998 Izume ..... 101/352.09
5,894,798 A 4/1999 Miyoshi et al.
5,974,970 A * 11/1999 Izume ..... 101/350.1
5,983,797 A * 11/1999 Secor ..... 101/350.6
6,349,645 B1 * 2/2002 Roskosch ..... 101/364

FOREIGN PATENT DOCUMENTS

DE 40 04 597 A1 8/1991

* cited by examiner

*Primary Examiner*—Andrew H. Hirshfeld
*Assistant Examiner*—Leo T. Hinze
(74) *Attorney, Agent, or Firm*—Workman Nydegger

(57) ABSTRACT

An inking apparatus according to the present invention includes an ink fountain roller, an ink fountain blade, a front end of which is position-adjustable to be located close to the outer circumference of the ink fountain roller, a pair of side plates, each standing upright from the ink fountain blade so that an arcuate front end surface encircles part of the outer circumference of the ink fountain roller to form an ink fountain for storing ink in cooperative with the ink fountain roller and the ink fountain blade, in which a permanent magnet is embedded in a bottom surface of each the side plate in contact with the ink fountain blade for fixing the side plate to a desired position of the ink fountain blade. The pair of side plates are movable relative to the ink fountain blade along an axis of the ink fountain roller.

11 Claims, 12 Drawing Sheets

INKING APPARATUS AND SIDE PLATE THEREOF

This application is based on Patent Application No. 2001-159043 filed May 28, 2001 in Japan, the content of which is incorporated hereinto by reference.

BACKGROUND OF THE INVENTION

1. Field of the Invention

The present invention relates to an inking apparatus used for a printing machine such as a rotary press and a side plate constituting part of the inking apparatus.

2. Description of the Prior Art

An inking apparatus provided with a plurality of rollers is incorporated in a printing machine, for supplying ink of a film form having a uniform thickness to a plate cylinder. This inking apparatus includes an ink fountain roller, an ink fountain blade and a pair of side plates. An ink fountain for storing ink is formed by the ink fountain roller, the ink fountain blade and the pair of side plates. In the inking apparatus, ink stored in the ink fountain and supplying the outer circumference of the ink fountain roller is made even by the plurality of rollers into a film form having a uniform thickness and supplied to the plate cylinder.

In the prior art inking apparatus to be incorporated into the printing machine, the ink fountain is formed to be fit to the maximum width of a printing sheet capable of being printed by the printing machine. Accordingly, if the printing is carried out while using a printing sheet of a smaller width, ink adhered to the widthwise opposite end portions of the rollers disposed from the ink fountain roller to the plate cylinder is not consumed but left as it is. Thus, the ink adhered to the widthwise opposite end portions of the rollers is gradually in an excessively supplied state, and flows toward the opposite ends of the respective rollers as it rotates to contaminate the printing machine.

In the prior art, to avoid such an inconvenience, a gap between a front end of the ink fountain blade for adjusting an amount of ink to be supplied from the ink fountain and the outer circumference of the ink fountain roller is precisely adjusted by a plurality of gap-adjustment screws.

The precise adjustment of the gap between the front end of the ink fountain blade and the outer circumference of the ink fountain roller requires a skillful technique. In the prior art, this adjustment is troublesome and may cause the decline of the operating efficiency of the rotary press.

The inking apparatus into which an ink fountain division control device is incorporated is free from such an inconvenience. However, the ink fountain division control device is extremely expensive to disturb the effort for lowering a cost of the rotary press. While the ink fountain division control device could divide the ink fountain, a width of the printing sheet must be selected in correspondence to the divided number of the ink fountain. Further, there may be a case wherein the width of the printing sheet could not be accurately matched with that of the ink fountain. Therefore, the incorporation of such an ink fountain division control device into a cheap and small-sized printing machine has not yet been popular by taking account of the comparison of the cost increase for incorporating the ink fountain division control device with the effect obtainable from the incorporation of the ink fountain division control device.

SUMMARY OF THE INVENTION

An object of the present invention is to provide an inking apparatus capable of optionally and easily varying a width of an ink fountain at a very low cost without replacing an ink fountain blade or others, and a side plate constituting part of the inking apparatus.

A first aspect of the present invention is an inking apparatus comprising an ink fountain roller, an ink fountain blade, a front end of which is position-adjustable to be located close to the outer circumference of the ink fountain roller, a pair of side plates, each standing upright from the ink fountain blade so that an arcuate front end surface encircles part of the outer circumference of the ink fountain roller to form an ink fountain for storing ink in cooperative with the ink fountain roller and the ink fountain blade, characterized in that a permanent magnet is embedded in a bottom surface of each the side plate in contact with the ink fountain blade for fixing the side plate to a desired position of the ink fountain blade so that the pair of side plates are movable relative to the ink fountain blade along an axis of the ink fountain roller.

In the first aspect of the present invention, when an ink adhesion area on the outer circumference of the ink fountain roller is to be changed, the pair of side plates are released from the magnetic force of the permanent magnet, moved to the desired position on the ink fountain blade and fixed again to the ink fountain blade by using the magnetic force of the permanent magnet.

According to the present invention, it is possible in advance to prevent ink from excessively being supplied to the ink fountain roller solely by varying a distance between the pair of side plates in accordance with the width of the printing medium. Also, it is possible to shorten a time required for preparation of a proofing operation because the replacement of the ink fountain blade is unnecessary. Further, it is possible to avoid the number of parts from increasing.

In the first aspect of the present invention, another permanent magnet embedded in the front end surface of each the side plate may be provided for holding the front end surface in tight contact with the outer circumference of the ink fountain roller, so that the ink is prevented from leaking out of the ink fountain.

Each the side plate may have a slope formed on an upper side of the front portion thereof to be slanted toward the ink fountain, so that the ink excessively adhered to the outer circumference of the ink fountain roller is smoothly guided to the ink fountain.

Preferably, each the side plate is made of a material having a hardness lower than that of a material forming the outer circumference of the ink fountain roller, so that the outer circumference of the ink fountain roller is prevented in advance from being damaged by the front end surface of the side plate.

A partitioning member interposed between the pair of side plates is further provided for defining an area in which the supply of ink to the outer circumference of the ink fountain roller is inhibited, which partitioning member has an arcuate front end surface encircling part of the outer circumference of the ink fountain roller, a bottom surface slidably contacting with the ink fountain blade, and a permanent magnet embedded in the bottom surface thereof for fixing the partitioning member at a desired position of the ink fountain blade, so that the area in which the supply of ink is inhibited is formed at an optional position on the ink fountain roller. In this case, the partitioning member may have a further permanent magnet embedded in the front end surface thereof for holding the front end portion in tight contact with the outer circumference of the ink fountain roller, so that the leakage of ink into the area on the ink fountain roller in which the supply of ink is inhibited is restricted. The partitioning member may have a pair of slopes formed on an upper side of the front end surface thereof, so that the ink excessively adhered to the outer circumference of the ink fountain roller is smoothly guided to the ink fountain to inhibit the ink from flowing into the area in which the supply of ink is inhibited. Preferably, the partitioning member is made from a material having a hardness lower than that of a material forming the outer circumference of the ink fountain roller, so that the outer circumference of the ink fountain roller is prevented in advance from being damaged by the front end surface of the partitioning member.

At least an upper surface of the ink fountain blade is preferably made from a ferromagnetic material, so that a magnetic force of the permanent magnet is effectively operative to favorably maintain the tight contact of the side plate and the partitioning member with the ink fountain blade.

A second aspect of the present invention is a side plate of an inking apparatus for forming an ink fountain for storing ink therein, a pair of the side plates being cooperative with an ink fountain roller and an ink fountain blade, a front end of the ink fountain blade being position-adjustable to be located close to the outer circumference of the ink fountain roller, each of the side plates standing upright from the ink fountain blade at a distance from the other so that an arcuate front end surface encircles part of the outer circumference of the ink fountain roller, characterized in that the side plate comprises a bottom surface for slidably contacting with the ink fountain blade and a permanent magnet embedded in the bottom surface thereof for fixing the side plate to a desired position of the ink fountain blade.

According to the present invention, it is possible in advance to prevent ink from excessively being supplied to the ink fountain roller solely by varying a distance between the pair of side plates in accordance with the width of the printing medium.

In the side plate according to the second aspect of the present invention, another permanent magnet may be embedded in the front end surface for maintaining the front end surface in tight contact with the outer circumference of the ink fountain roller, so that the ink is prevented from leaking out of the ink fountain.

A slope slanted toward the ink fountain may be formed on the upper side of front end surface, so that the ink excessively adhered to the outer circumference of the ink fountain roller is smoothly guided to the ink fountain, not to flow into the area in which the supply of ink is inhibited.

The side plate is preferably made from brass, so that the outer circumference of the ink fountain roller is prevented in advance from being damaged by the front end surface of the side plate.

The above and other objects, effects, features and advantages will be more apparent from the following description of the preferred embodiments with reference to the attached drawings.

DETAILED DESCRIPTION OF PREFERRED EMBODIMENTS

The present invention will be described below with reference to FIGS. 1 to 12 illustrating the preferred embodiments in which an inking apparatus according to the present invention is applied to a printing machine. It should be noted that the present invention is not limited to these embodiments but includes various changes and modifications thereof within the concept of the present invention defined by claims. Accordingly, the present invention is of course applicable to other technologies within a spirit of the present invention.

Figure 1:
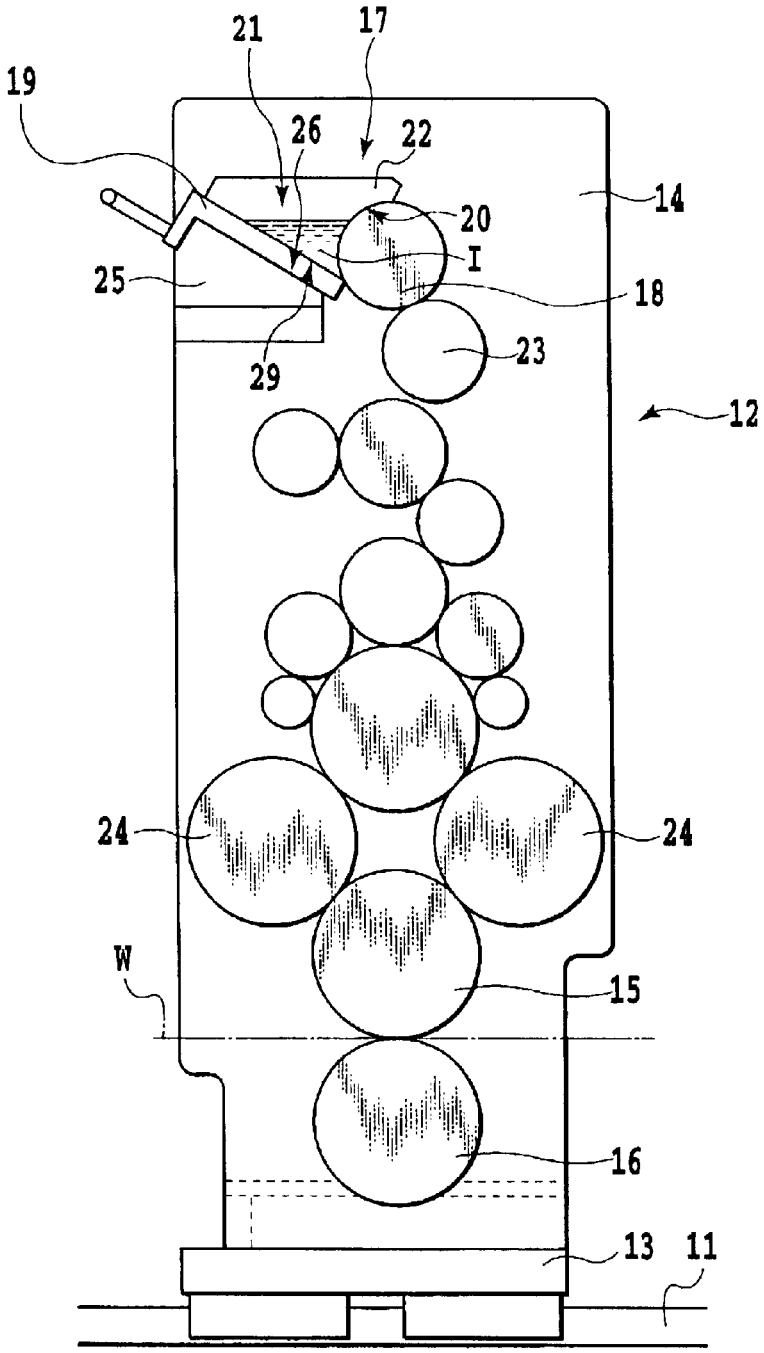
FIG. 1 is a conceptual illustration of a schematic structure of one embodiment of a printing machine incorporating an inking apparatus according to the present invention.
Figure 2:
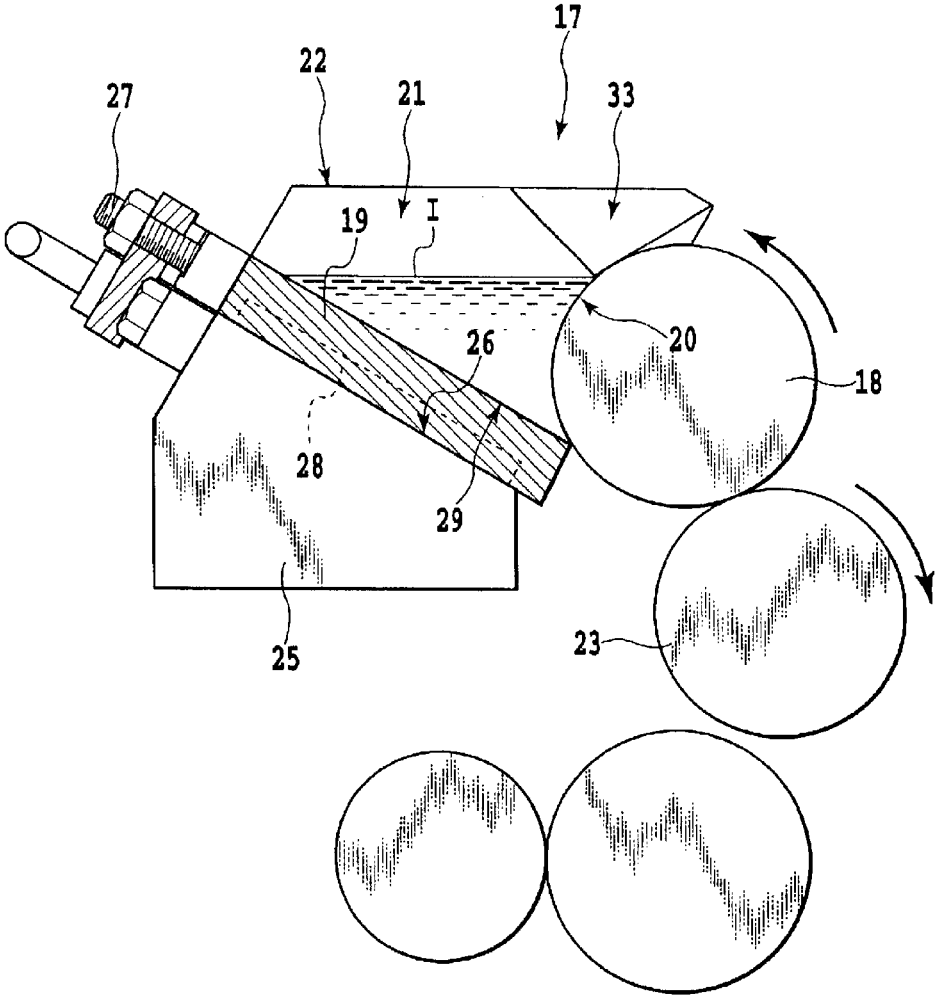
FIG. 2 is an enlarged view of part of the inking apparatus in the embodiment shown in FIG. 1.
Figure 3:
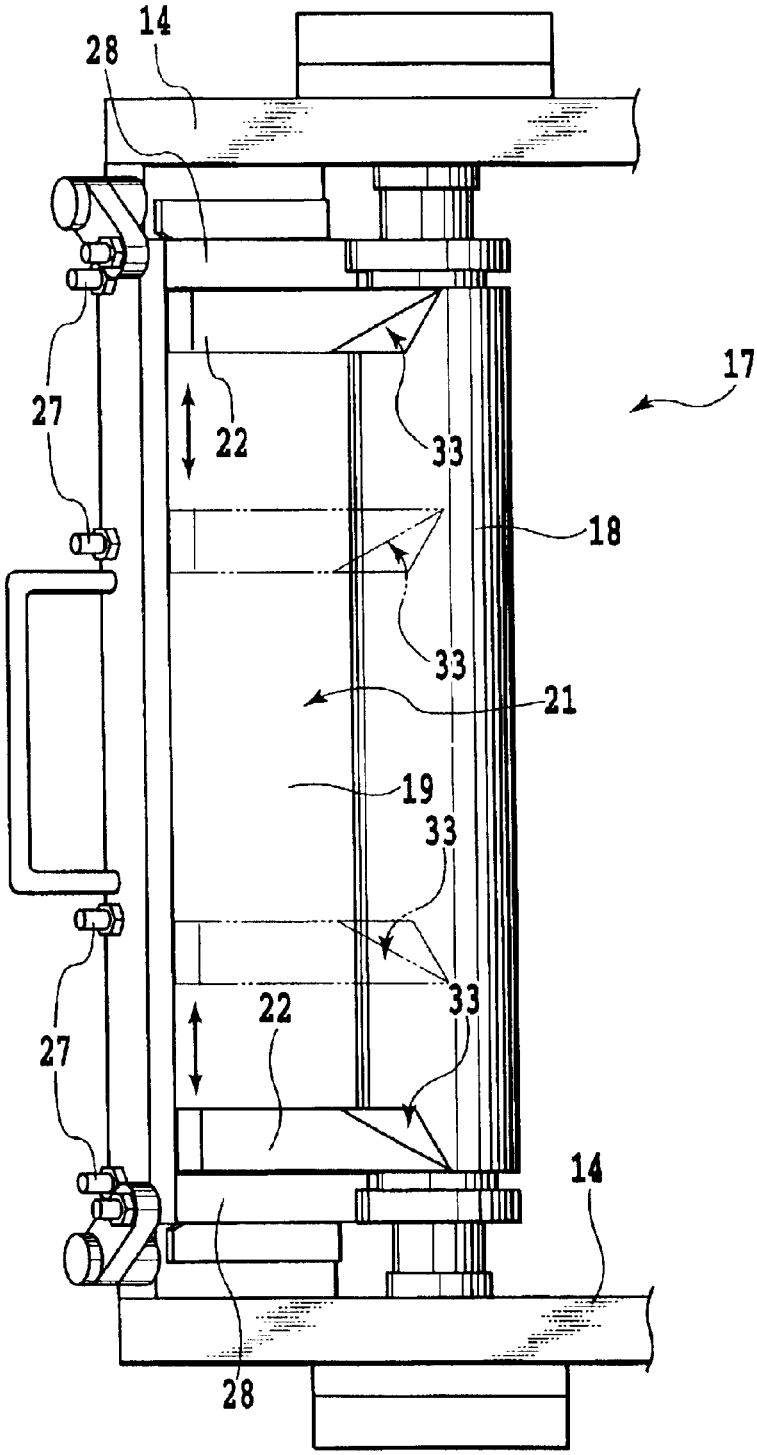
FIG. 3 is a plan view of the part of the inking apparatus shown in FIG. 2.

A schematic construction of a printing machine according to the present invention is shown in FIG. 1, a main part of an inking apparatus is illustrated in an enlarged manner in FIG. 2, and a planar structure thereof is shown in FIG. 3. A pair of left and right frames 14 stand on a base 13 of a printing machine 12 disposed on guide rails 11. A cylindrical plate cylinder 15 is supported for rotation at the opposite axial ends thereof on these frames 14 via bearings (not shown). A printing plate not shown is detachably mounted onto the outer circumference of the plate cylinder 15. In a similar manner, an impression cylinder 16 is also supported for rotation at the axial opposite ends thereof on the pair of left and right frames 14 via bearings (not shown), so that a web W passes through a gap between the same and the plate cylinder 15. The gap between the plate cylinder 15 and the impression cylinder 16 is adjustable by means of a gap adjustment mechanism (not shown).

Above the plate cylinder 15, an inking apparatus 17 according to one embodiment of the present invention is incorporated. This inking apparatus 17 includes an ink fountain roller 18, an ink fountain blade 19, which a front end thereof is position-adjustable to be located close to the outer circumference of the ink fountain roller 18, a pair of side plates 22 forming an ink fountain 21 for storing ink I in cooperative with the ink fountain roller 18 and the ink fountain blade 19, and a plurality of rollers disposed from an ink transfer roller 23 rotating while being in contact with the ink fountain roller 18 to a form roller 24 rotating while being in contact with the plate cylinder 15. Each the side plate 22 stands upright from the ink fountain blade 19 so that an arcuate front end surface 20 encircles part of the outer circumference of the ink fountain roller 18. The ink fountain roller 18 and the roller group subsequent thereto, including the ink transfer roller 23 and the form roller 24, are also supported for rotation on the pair of frames 14.

The ink I supplied from the ink fountain roller 18 to the ink transfer roller 23 is coated via the form roller 24 as an ink film having a uniform thickness on the printing plate mounted to the plate cylinder 15, while kneaded by the roller group.

A slide guide plate 28 is provided at each of opposite ends of a machined slope 26 of a bracket 25 fixed to the frame 14 along an axis of the ink fountain roller 18. The ink fountain blade 19 made from a steel plate is slidably placed on the machined slope 26 of the bracket 25 via the slide guide plate 28. A plurality of gap-adjustment screws 27 coupled to the frame 14 are attached to a proximal end of the ink fountain blade 19. Thus, by adjusting an amount of screw-engagement of the gap-adjustment screws 27 relative to the frame 14, it is possible to optimally adjust the gap between the front end of the ink fountain blade 19 and the outer circumference of the ink fountain roller 18.

Figure 4:
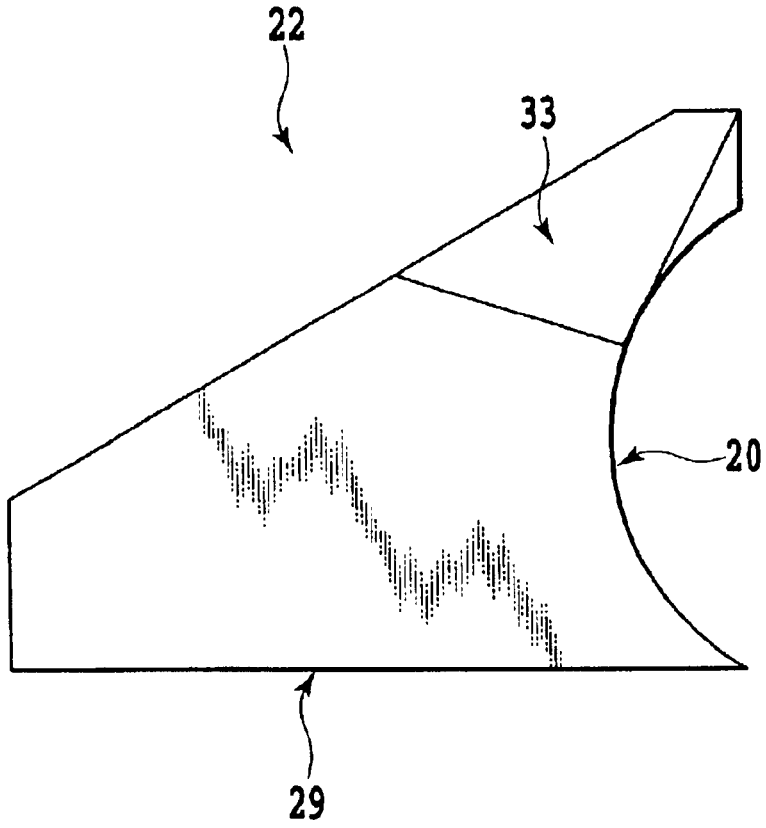
FIG. 4 is a side view representing an appearance of one embodiment of a side plate according to the present invention.
Figure 5:
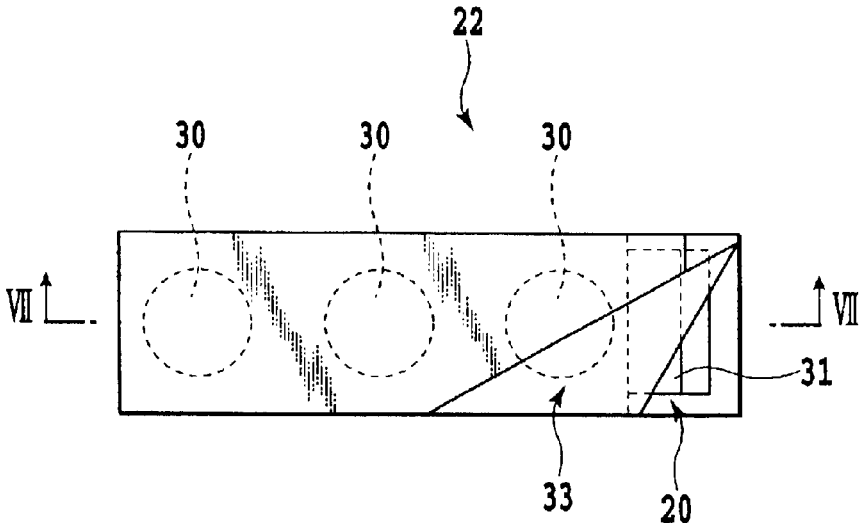
FIG. 5 is a plan view of the side plate shown in FIG. 4.
Figure 6:
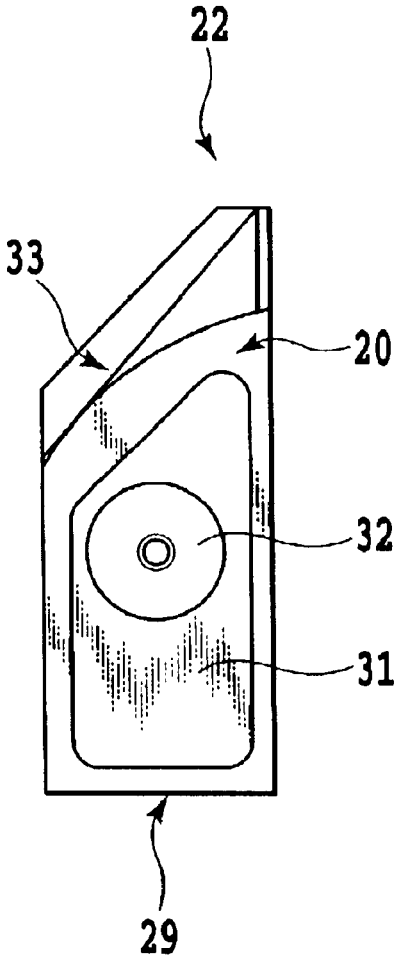
FIG. 6 is a front view of the side plate shown in FIG. 4.
Figure 7:
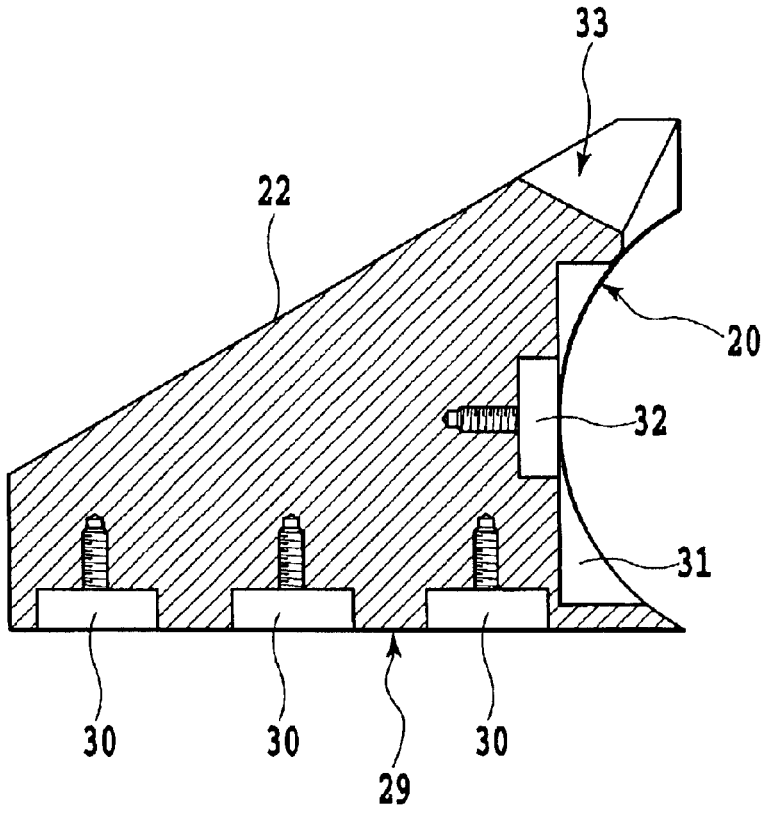
FIG. 7 is a sectional view taken along a line VII—VII in FIG. 5.

A side view of the side plate 22 according to this embodiment is shown in FIG. 4, a plan view and a front view are shown in FIGS. 5 and 6, respectively, and a sectional view taken along a line VII—VII in FIG. 5 is shown in FIG. 7. On a bottom surface 29 of the side plate 22 to be in tight contact with a surface of the ink fountain blade 19, a plurality of permanent magnets 30 (three in the illustrated embodiment) are fixed by screws, for securing the side plate 22 at a desired position on the ink fountain blade 19 by using a magnetic force. These permanent magnets 30 are embedded in the side plate 22 not to protrude from the bottom surface 29 of the side plate 22. Accordingly, by releasing the side plate 22 from the ink fountain blade 19 against the magnetic force, it is possible to relocate the side plate 22 relative to the ink fountain blade 19 along an axis of the ink fountain roller 18 at an optional position, for example, shown by a double dashed line in FIG. 3. That is, by adjusting a distance between the pair of side plates 22 in correspondence to a width of a web W used in the printing machine 12, it is possible to prevent the ink I from excessively spreading into axial opposite end areas of the ink fountain roller 18 and being supplied to the plate cylinder 15.

According to this embodiment, the side plate 22 is made from brass having a hardness lower than that of the ink fountain blade 19 or the ink fountain roller 18 so that the bottom surface 29 of the side plate 22 is maintained to be in tight contact with the ink fountain blade 19 as well as the outer circumference of the ink fountain roller 18 is not damaged by an arcuate front end surface 20 of the ink fountain blade 19. A spot-face 31 is formed in an inner region of the front end surface 20 to reduce a contact area thereof with the outer circumference of the ink fountain roller 18. To further facilitate the tight contact of the front end surface 20 of the side plate 22 with the outer circumference of the ink fountain roller 18 due to the magnetic force, a permanent magnet 32 is fixed to the spot-face 31 with a screw. To prevent the end surface of the permanent magnet 32 from being in contact with the outer circumference of the ink fountain roller 18, the permanent magnet 32 is embedded into the side plate 22 so that the end surface of the permanent magnet 32 is located inner than the arcuate front end surface 20 of the side plate 22.

While the permanent magnet 32 is embedded in the side plate 22 to be attracted to the ink fountain blade 19 in this embodiment, the ink fountain blade 19 itself may be made from a permanent magnet and the side plate 22 may be made from metal capable being attracted by the magnetic force thereof. Further, this metal may be embedded in the side plate 22.

A slope 33 slanted toward the ink fountain 21 is provided on the upper side of the front end surface 20 of the side plate 22. To prevent the ink I from spreading to a whole area of the outer circumference of the ink fountain roller 18, the slope 33 has a function for scraping of f the ink I into the ink fountain 21, which ink is adhered to the outer circumference of the ink fountain roller 18 and spreads toward the opposite ends thereof.

To further securely preventing the ink I from spreading to the axial opposite ends of the ink fountain roller 18, it is effective to arrange a plurality of the pair of adjacent side plates 22 described above on the ink fountain blade 19. On the same point of view, the partitioning member 34 may be interposed between these pairs of side plates 22, for defining an area in which the supply of ink to the outer circumference of the ink fountain roller 18 is inhibited (see FIG. 8).

Figure 8:
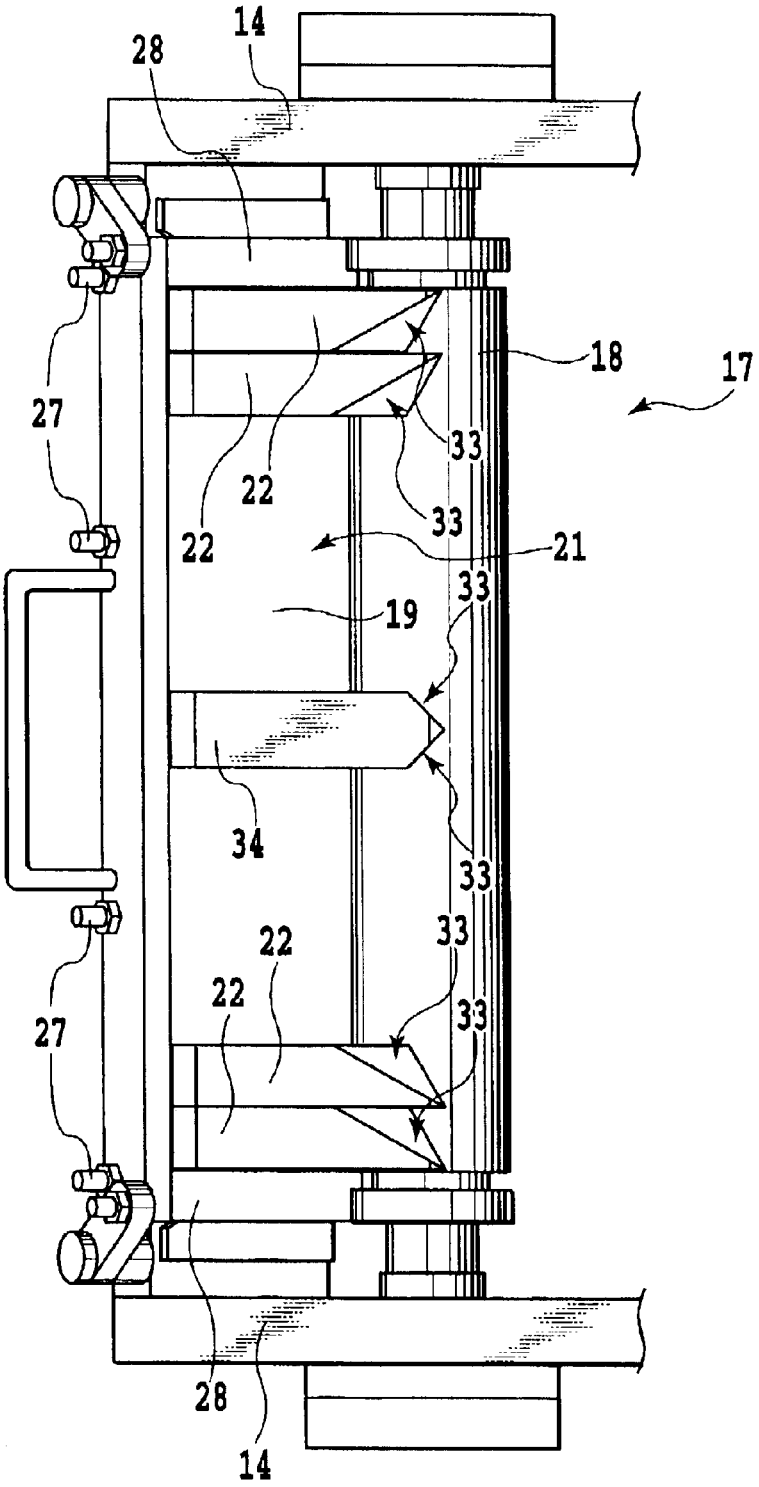
FIG. 8 is a plan view representing an appearance of another embodiment according to the present invention in which two side plates of the inking apparatus are used while being in tight contact with each other.
Figure 9:
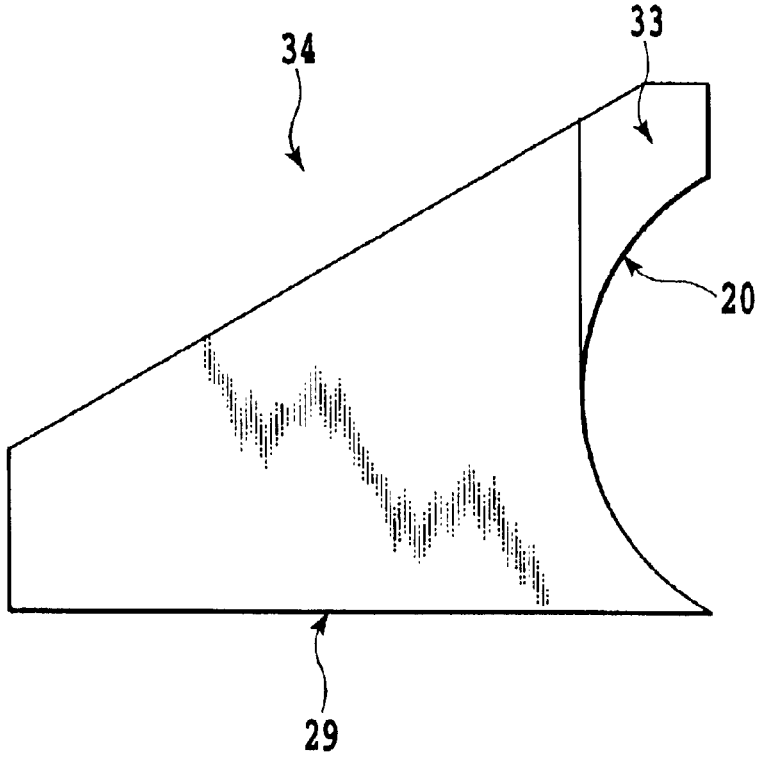
FIG. 9 is a side view of a partitioning member incorporated in the inking apparatus shown in FIG. 8.
Figure 10:
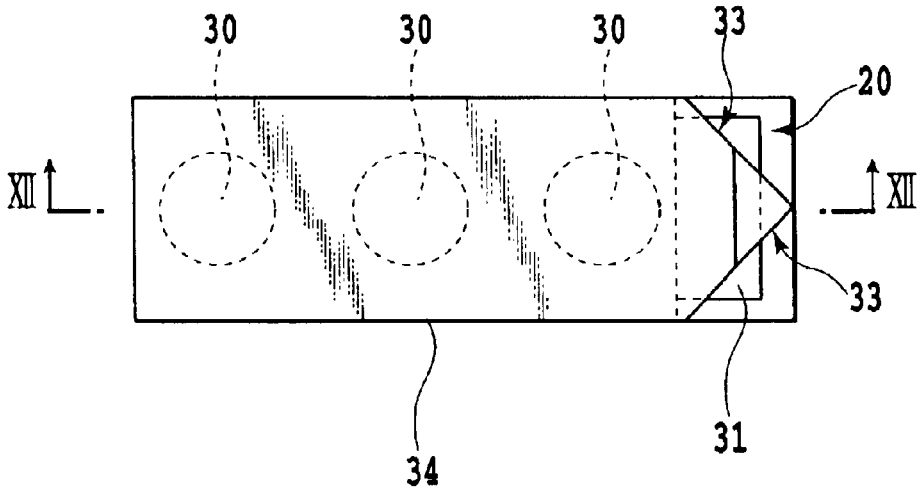
FIG. 10 is a plan view of the partitioning member shown in FIG. 9.
Figure 11:
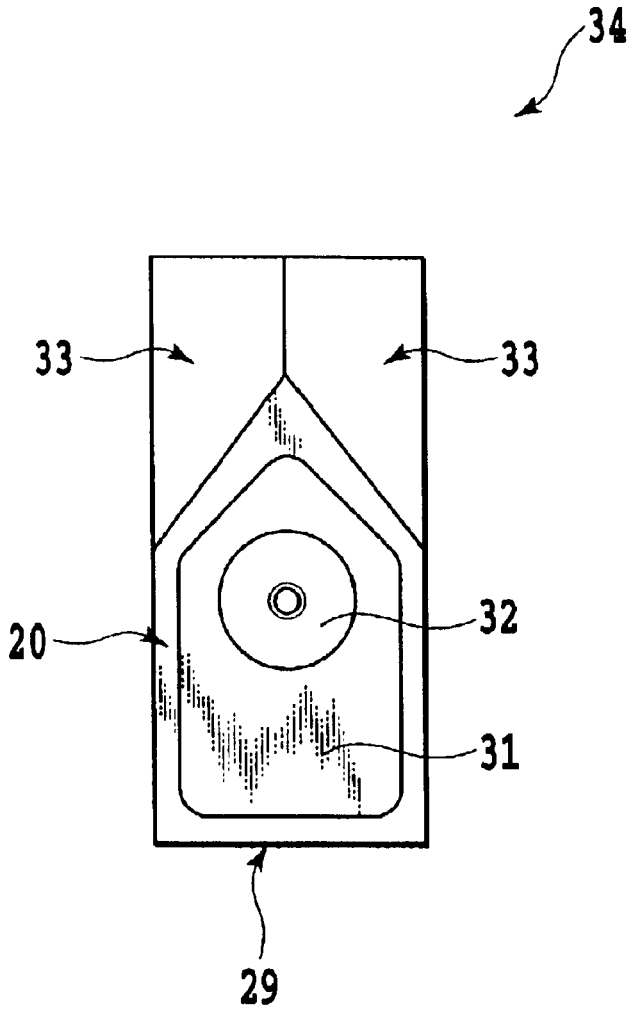
FIG. 11 is a front view of the partitioning member shown in FIG. 9.
Figure 12:
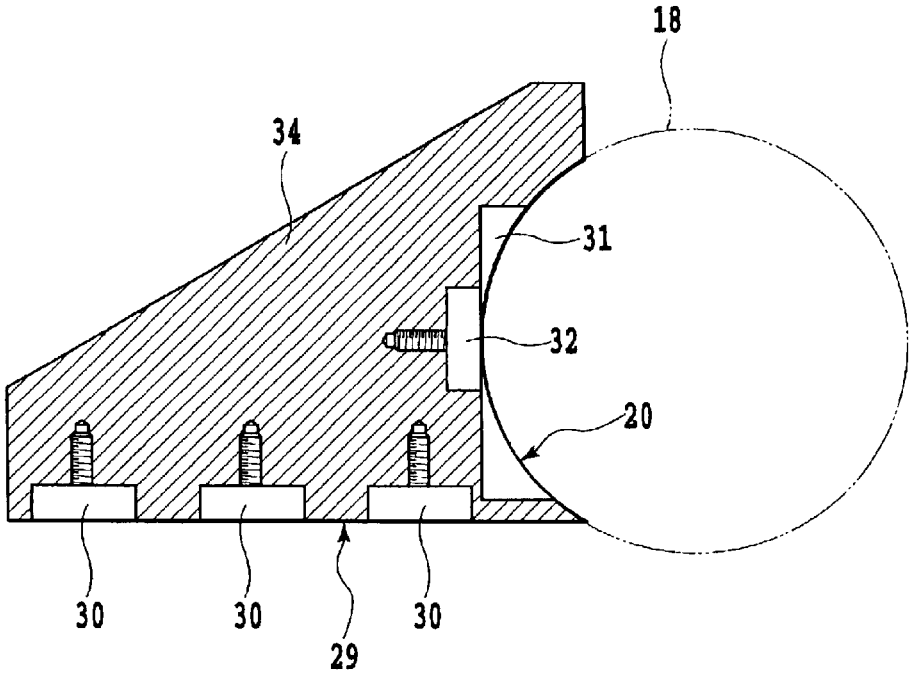
FIG. 12 is a sectional view taken along a line XII—XII in FIG. 10.

A planar structure of another embodiment of the present invention is shown in FIG. 8, a side view of a partitioning member 34 thereof is shown in FIG. 9, a plan view and a front view thereof are shown in FIGS. 10 and 11, respectively, and a sectional view taken along a line XII—XII in FIG. 10 is shown in FIG. 12. In these drawings, the same reference numerals are used for denoting parts having the same function as in the preceding embodiment and the superfluous explanation thereof will be eliminated. According to this embodiment, a plurality (two in the illustrated embodiment) of side plates 22 in tight contact with each other are fixed at a desired position on the respective end the ink fountain blade 19 by using a magnetic force. A distance between both the inner side plates 22 positioned along an axis of the ink fountain roller 18 corresponds to a width of a printing surface of the web W used. A basic configuration and structure of the partitioning member 34 is substantially the same as used in the preceding embodiment. The difference is that the slope 33 is formed on the respective side thereof.

Accordingly, both the outer side plates 22 positioned along an axis of the ink fountain roller 18 guide the ink I spreading to the axial opposite ends of the ink fountain roller 18 toward a region between the both. The area in which the supply of ink I to the ink fountain roller 18 is inhibited is a region corresponding to a width of the partitioning member 34. By replacing the partitioning member 34 to that having a different width, the area in which the supply of ink I is inhibited may be formed at an optional position along an axis of the ink fountain roller 18.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An inking apparatus comprising:

an ink fountain roller;

an ink fountain blade, which a front end thereof is position-adjustable to be located close to the outer circumference of said ink fountain roller;

a pair of side plates, each standing upright from said ink fountain blade so that an arcuate front end surface encircles part of the outer circumference of said ink fountain roller to form an ink fountain for storing ink in cooperation with said ink fountain roller and said ink fountain blade;

a permanent magnet being embedded in a bottom surface of each said side plate in contact with said ink fountain blade for fixing said side plate to a desired position of said ink fountain blade so that said pair of side plates are movable relative to said ink fountain blade along an axis of said ink fountain roller;

a recessed pocket being formed on the front end surface of each side plate; and another permanent magnet being embedded within the recessed pocket of each side plate so that the front end surface of each said side plate is held in tight contact with the outer circumference of the ink fountain roller and so that an end surface of the permanent magnet within the recessed pocket is located inner that of the arcuate front end surface of each said side plate, each recessed pocket at least partially bounding an open area directly adjacent to the ink fountain roller when the front end surface of each side plate is biased against the ink fountain roller.

2. An inking apparatus as claimed in claim 1, wherein each said side plate has a slope formed on an upper side of the front portion thereof to be slanted toward said ink fountain.

3. An inking apparatus as claimed in claim 1, wherein each said side plate is made of a material having a hardness lower than that of a material forming the outer circumference of said ink fountain roller.

4. An inking apparatus as claimed in claim 1, further comprising a partitioning member interposed between said pair of side plates for defining an area in which the supply of ink to the outer circumference of said ink fountain roller is inhibited, which said partitioning member has an arcuate front end surface encircling part of the outer circumference of said ink fountain roller, a bottom surface for slidably contacting with said ink fountain blade, and a permanent magnet embedded in the bottom surface thereof for fixing said partitioning member at a desired position of said ink fountain blade.

5. An inking apparatus as claimed in claim 4, wherein said partitioning member has a further permanent magnet embedded in the front end surface thereof for holding the front end portion in tight contact with the outer circumference of said ink fountain roller.

6. An inking apparatus as claimed in claim 4, wherein said partitioning member has a pair of slopes formed on an upper side of the front end surface thereof.

7. An inking apparatus as claimed in claim 4, wherein said partitioning member is made from a material having a hardness lower than that of a material forming the outer circumference of said ink fountain roller.

8. An inking apparatus as claimed in claim 1, wherein at least an upper surface of said ink fountain blade is made from a ferromagnetic material.

9. A side plate of an inking apparatus for forming an ink fountain for storing ink therein, a pair of said side plates being cooperative with an ink fountain roller and an ink fountain blade, a front end of the ink fountain blade being position-adjustable to be located close to the outer circumference of the ink fountain roller, each of said side plates standing upright from the ink fountain blade at a distance from the other so that an arcuate front end surface encircles part of the outer circumference of the ink fountain roller, said side plate comprising:

a bottom surface slidably contacting with the ink fountain blade;

a permanent magnet embedded in the bottom surface thereof for fixing said side plate to a desired position of the ink fountain blade;

a recessed pocket being formed on the front end surface; and another permanent magnet being embedded within the recessed pocket so that the front end surface is held in tight contact with the outer circumference of the ink fountain roller and so that an end surface of the permanent magnet within the recessed pocket is located inner that of the arcuate front end surface, the recessed pocket at least partially bounding an open area directly adjacent to the ink fountain roller when the front end surface is biased against the ink fountain roller.

10. A side plate of an inking apparatus as claimed in claim 9, wherein a slope slanted toward the ink fountain is formed on an upper side of the front end surface.

11. A side plate of an inking apparatus as claimed in claim 9, wherein said side plate is made from brass.

* * * * *